US009605490B2

(12) United States Patent
Hess et al.

(10) Patent No.: US 9,605,490 B2
(45) Date of Patent: Mar. 28, 2017

(54) RISER ISOLATION TOOL FOR DEEPWATER WELLS

(71) Applicant: Halliburton Energy Services, Inc., Houston, TX (US)

(72) Inventors: Joe E. Hess, Richmond, TX (US); Andrew John Cuthbert, Spring, TX (US); Ronald Wayne Courville, Richmond, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/773,670

(22) PCT Filed: Sep. 3, 2014

(86) PCT No.: PCT/US2014/053898
§ 371 (c)(1),
(2) Date: Sep. 8, 2015

(87) PCT Pub. No.: WO2016/036362
PCT Pub. Date: Mar. 10, 2016

(65) Prior Publication Data

US 2016/0230474 A1 Aug. 11, 2016

(51) Int. Cl.

| | |
|---|---|
| ***E21B 17/01*** | (2006.01) |
| ***E21B 17/10*** | (2006.01) |
| ***E21B 33/038*** | (2006.01) |
| ***E21B 33/064*** | (2006.01) |

(52) U.S. Cl.
CPC ..... *E21B 17/01* (2013.01); *E21B 17/1007* (2013.01); *E21B 33/038* (2013.01); *E21B 33/064* (2013.01)

(58) Field of Classification Search
CPC ..... E21B 17/01; E21B 17/10; E21B 19/004; E21B 19/006; E21B 33/038; E21B 33/064; E21B 17/1007
See application file for complete search history.

(56) References Cited

U.S. PATENT DOCUMENTS 3,032,125 A * 5/1962 Hiser ..... E21B 17/01 166/341
3,196,958 A * 7/1965 Travers ..... E21B 7/128 166/350

(Continued)

FOREIGN PATENT DOCUMENTS

EP 1270870 B1 8/2006

OTHER PUBLICATIONS

"International Application No. PCT/US2014/053898, International Search Report mailed Jun. 10, 2015", 4 pgs.

(Continued)

*Primary Examiner* — Matthew R Buck
(74) *Attorney, Agent, or Firm* — Chamberlain Hrdlicka

(57) ABSTRACT

In a subsea drilling operation, a riser isolation tool may be installed inside a marine riser between the subsea wellhead and the rig floor to provide a conduit having a higher pressure rating than the original riser itself. In some embodiments, the riser isolation tool includes a tubular body and, extending therefrom, a seal stinger sized to be slidably received in a receptacle seated in the wellhead. Additional apparatus, systems, and methods are disclosed.

20 Claims, 4 Drawing Sheets

(56) References Cited

U.S. PATENT DOCUMENTS

| | | | | |
|---|---|---|---|---|
| 5,533,574 | A * | 7/1996 | Gonzalez | E21B 17/01 166/358 |
| 6,273,193 | B1 * | 8/2001 | Hermann | E21B 7/128 166/350 |
| 7,073,593 | B2 * | 7/2006 | Hatton | E21B 7/128 166/345 |
| 7,237,613 | B2 * | 7/2007 | Radi | E21B 17/01 166/358 |
| 7,658,228 | B2 * | 2/2010 | Moksvold | E21B 17/01 166/345 |
| 8,733,447 | B2 * | 5/2014 | Mouton | E21B 17/07 166/355 |
| 8,960,307 | B2 * | 2/2015 | Cain | E21B 33/038 166/345 |
| 9,303,480 | B2 * | 4/2016 | Williams | E21B 33/038 |
| 2005/0217845 | A1 * | 10/2005 | McGuire | E21B 34/045 166/100 |
| 2008/0066922 | A1 * | 3/2008 | Blakseth | E21B 17/01 166/350 |
| 2008/0185152 | A1 | 8/2008 | Sbordone et al. | |
| 2010/0018715 | A1 | 1/2010 | Orbell et al. | |
| 2012/0211236 | A1 * | 8/2012 | Braithwaite | E21B 33/038 166/348 |
| 2012/0227978 | A1 | 9/2012 | Fossli et al. | |
| 2013/0111985 | A1 | 5/2013 | Veeningen | |
| 2014/0144648 | A1 * | 5/2014 | McKay | E21B 33/035 166/367 |

OTHER PUBLICATIONS

"International Application No. PCT/U52014/053898, Written Opinion mailed Jun. 10, 2015", 5 pgs.

* cited by examiner

RISER ISOLATION TOOL FOR DEEPWATER WELLS

PRIORITY APPLICATIONS

This application is a U.S. National Stage Filing under 35 U.S.C. 371 from International Application No. PCT/US2014/053898, filed on 3 Sep. 2014; which application is incorporated herein by reference in its entirety.

BACKGROUND

In a deep-water drilling operation, a marine riser is typically employed to provide a conduit between the subsea well and the surface drilling facility (also referred to as an "oil platform" or "drilling rig") for the removal of drilling mud and cuttings or of other fluids emanating from the wellbore. The riser usually includes lower and upper sections of large-diameter pipes connected via a slip joint that allows for relative vertical motion between the two sections to accommodate any rig heave. The upper pipe section may be fixedly attached to the rig floor, while the lower pipe section may be suspended from the rig by tensioner cables. At the bottom end, the lower pipe may be secured to a sub-sea blowout preventer (BOP) via a flexible joint. During a sudden influx of hydrocarbon or other formation fluids into the well (often referred to as a "kick"), the BOP functions as a valve that controls pressure by restricting and/or shutting off upward fluid flow. The pressures encountered in the marine riser during such a "well-killing" operation, or in the event of a BOP failure, can exceed typical marine-riser pressure ratings, causing the riser to burst or collapse and, as a result, allowing formation fluids to escape into the sea.

DESCRIPTION

To increase the efficiency of subsea drilling (including well-killing and well-control operations), an existing marine riser may be more effectively isolated from excessive pressures by means of an inner liner structure, hereinafter referred to as a "riser isolation tool" (RIT), that has higher pressure ratings then the riser itself, and which may be installed prior to drilling portions of the well that entail an increased risk of uncontrolled fluid influx. Such riser isolation tools, as well as systems and methods employing same, are described herein.

In various embodiments, after drilling of a subsea borehole has begun, a conventional marine riser (e.g., an L-80 grade steel riser) with upper and lower parts that are slidably coupled to each other is installed to provide an initial conduit between a surface drilling facility and a subsea BOP mounted above a subsea wellhead. At a later point during the drilling operation, generally prior to drilling of the "open hole" (i.e., penetration of the subsea reservoir), the RIT is installed, functionally replacing the existing riser. The RIT is generally a tubular structure, including a tool body (which may be comprised of sections (or lengths) of jointed pipe), and a seal stinger extending therefrom, with a maximum outer diameter sized to fit inside the riser (while leaving an annulus) and a minimum inner diameter sized to accommodate the drill string and casing used to drill and complete subsequent sections of the well. The tool body of the RIT, and optionally the steal stinger, has burst and collapse pressure ratings that exceed the burst and collapse pressure ratings of the marine riser, in some embodiments by a factor of two, four, or more. To provide a non-limiting example, an RIT body made of 2014 aluminum alloy and having a wall thickness of about 3.25 inches can achieve a burst pressure rating of 19,842 psi, whereas the burst pressure rating of an L-80 marine riser is only 4,167 psi. Thus, an RTI body constructed from 2014 aluminum with a wall thickness of about three inches may be useful in selected circumstances, such as those described herein.

Installation of the RIT may involve removing the upper part of the marine riser, running the RIT through the lower part of the marine riser, and slidably inserting the seal stinger into a receptacle disposed in the wellhead. The seal stinger may include a tubular component circumferentially surrounded, at multiple locations along its length, by seal stacks that allow sealing the stinger against the interior wall of the receptacle. Following installation of the RIT, which mechanically isolates the original riser as well as the subsea BOP from the wellbore, an upper BOP may be installed between the upper end of the RIT and the surface drilling facility; the BOP may, for instance, be secured to the surface drilling facility via a bell nipple.

Figure 1:
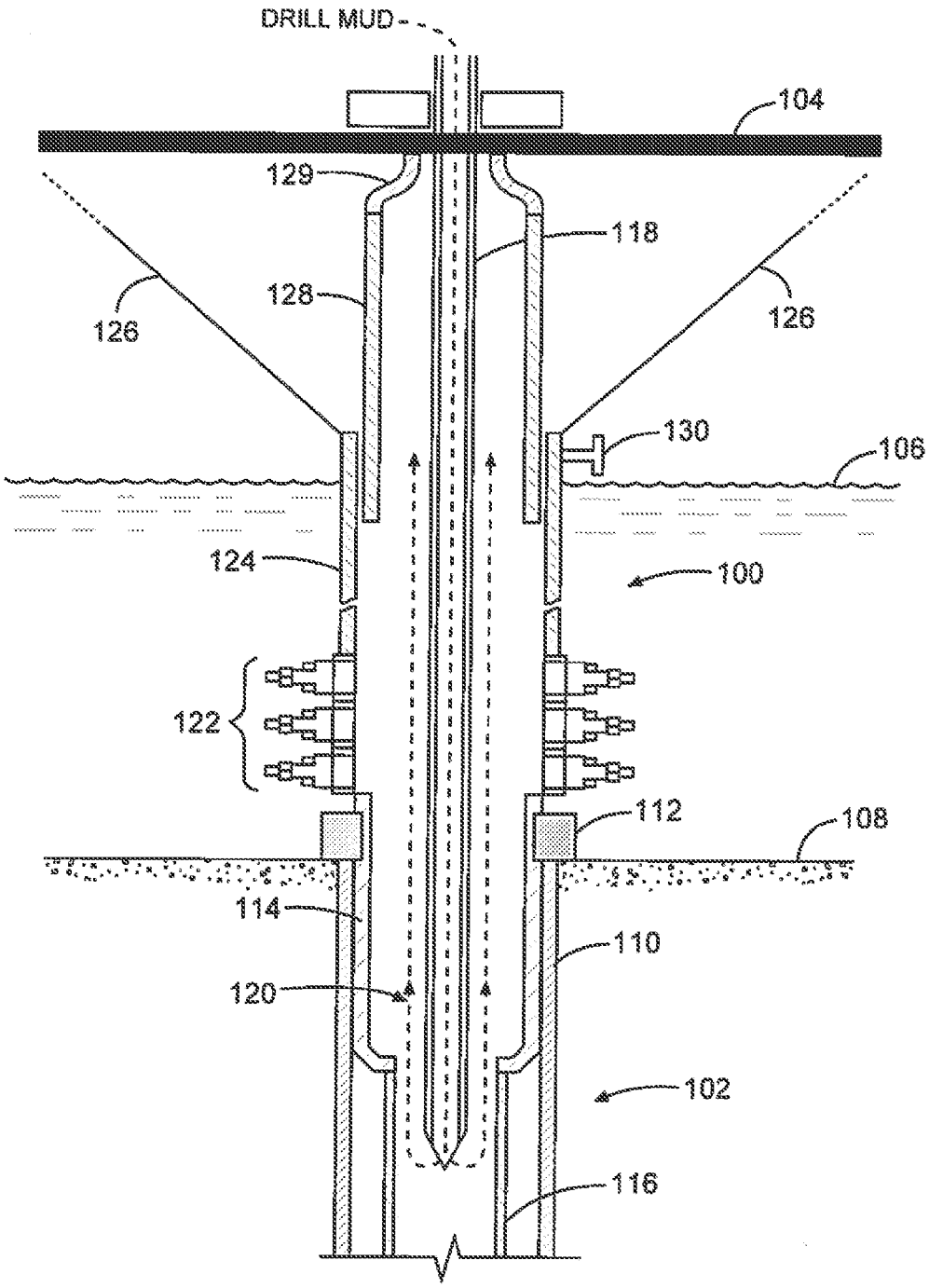
FIG. 1 depicts a marine riser installed between a subsea well and a surface drilling facility.

FIG. 1 schematically illustrates a marine riser 100 installed between a subsea well 102 and the floor 104 of a drilling rig located above sea level 106. (For the sake of emphasizing key components of the depicted system and configuration, the drawing is not to scale and does not depict the true aspect ratios of certain components and their configuration. For example, the depicted riser and drill string may in reality be much longer, compared with their width, than shown in the drawing.) The well 102 may be drilled in multiple phases, using drill bits of decreasing diameters, until the reservoir is reached. After completion of a phase, the respective portion of the wellbore may be lined with steel pipe, called casing, which may be cemented in place. In an example drilling and casing program, the first portion of the well may be drilled with a 36" drill bit and lined with 30" casing (i.e., casing having an outer diameter of 30"). The next section may be drilled with a 26" bit and lined with 20" casing. Subsequent sections may utilize a 17½" bit and 13⅜" casing, followed by a 12¼" bit and 9⅝" casing, followed by an 8½" bit and 7" casing. Of course, the drilling operation may begin with a smaller or larger initial diameter, depending, for example, on the depth below the mud line 108 at which the reservoir is expected. Indeed, any number of diameters may be used. However, to make the following discussion more concrete, the surface casing 108 (i.e., the uppermost casing) is assumed to be 20" casing.

After the surface casing 110 has been run into the well 102 and cemented, a wellhead 112 including sealing and hanging equipment is connected to the top of the casing 110. The subsequent, smaller-diameter casing pipes are hung either from the wellhead 112 (directly or indirectly), or from preceding pipes. For example, as shown in FIG. 1, a receptacle 114 (e.g., a polished-bore receptacle) hung from the wellhead 112 forms a tie-back to the 13⅜" casing 116 run inside the 20" casing. The receptacle 114 may have an outer diameter of 18", designed to be small enough to fit within the inner diameter of the 20" casing 110; the receptacle 114 may have an inner diameter of 16". The receptacle 114 may form an integral part of the casing 13⅜" casing, or alternatively an insert.

During drilling, drilling mud is pumped from the rig through the drill string 118 down to the drill bit (as shown by the dashed lines indicating mud flow). In addition to cooling the drill bit, the drilling mud serves to transport drill cuttings up through the annulus 120 formed between the drill string 118 and the wellbore and out of the well 102. In a subsea operation, the mud circulates back to the surface facility once the marine riser 100 (which may be made, e.g., of steel) has been installed. The riser 100 may be connected as soon as the surface casing 110 and wellhead 112 are in place. At its lower end, the riser 100 may include a lower marine riser package (LMRP) (not shown) including, e.g., a hydraulic connector, annular BOP, ball/flex joint, riser adapter, jumper hoses for choke, kill, and auxiliary lines (as are used, e.g., in a well-killing operation), and subsea control modules. A subsea BOP 122 may be attached to the LMRP at the bottom of the riser 100 and mounted between the riser 100 and the wellhead 112, as shown in FIG. 1. A flexible joint (not shown) may be included between the riser 100 and BOP 122 to allow the riser to tilt as necessary if the rig moves laterally relative to the wellhead 112. The inner diameter (ID) and outer diameter (OD) of the riser 100 generally depend on the dimensions of the surface casing 110. A common marine riser used in conjunction with 20" surface casing may have, e.g., a 21" OD and a 19¾" ID. Following installation of the riser 100, the drill string and casing are run through the riser into the wellbore.

The riser 100 includes two parts: a lower part 124 (which includes the LMRP) extends from the BOP 122 upwards and is tied to the rig via tensioner cables 126 that hold it laterally in place and prevent buckling in case of rig heave, and an upper part 128 extends from a bell nipple 129 suspended from the floor 104 of the drilling rig downwards and is slidably coupled to the lower part via a slip joint located above sea level. This allows relative vertical motion between the two parts 124, 148 of the riser 100 when the rig moves up or down, for example, due to tides or windy conditions. The length of the upper riser part 128 is generally selected to accommodate the full expected range of rig heave, e.g., 40 feet or more, while maintaining a continuous conduit between the wellhead 112 and the rig floor 104. As shown, the lower part 124 of the riser 100 may include flanged inlets and outlets 130 that allow for fluidic connections between the interior and exterior of the riser 100, as may be used, e.g., to pump out fluids contained in the riser prior to running the drill string therethrough, installing the RIT, or performing other operations.

Figure 2:
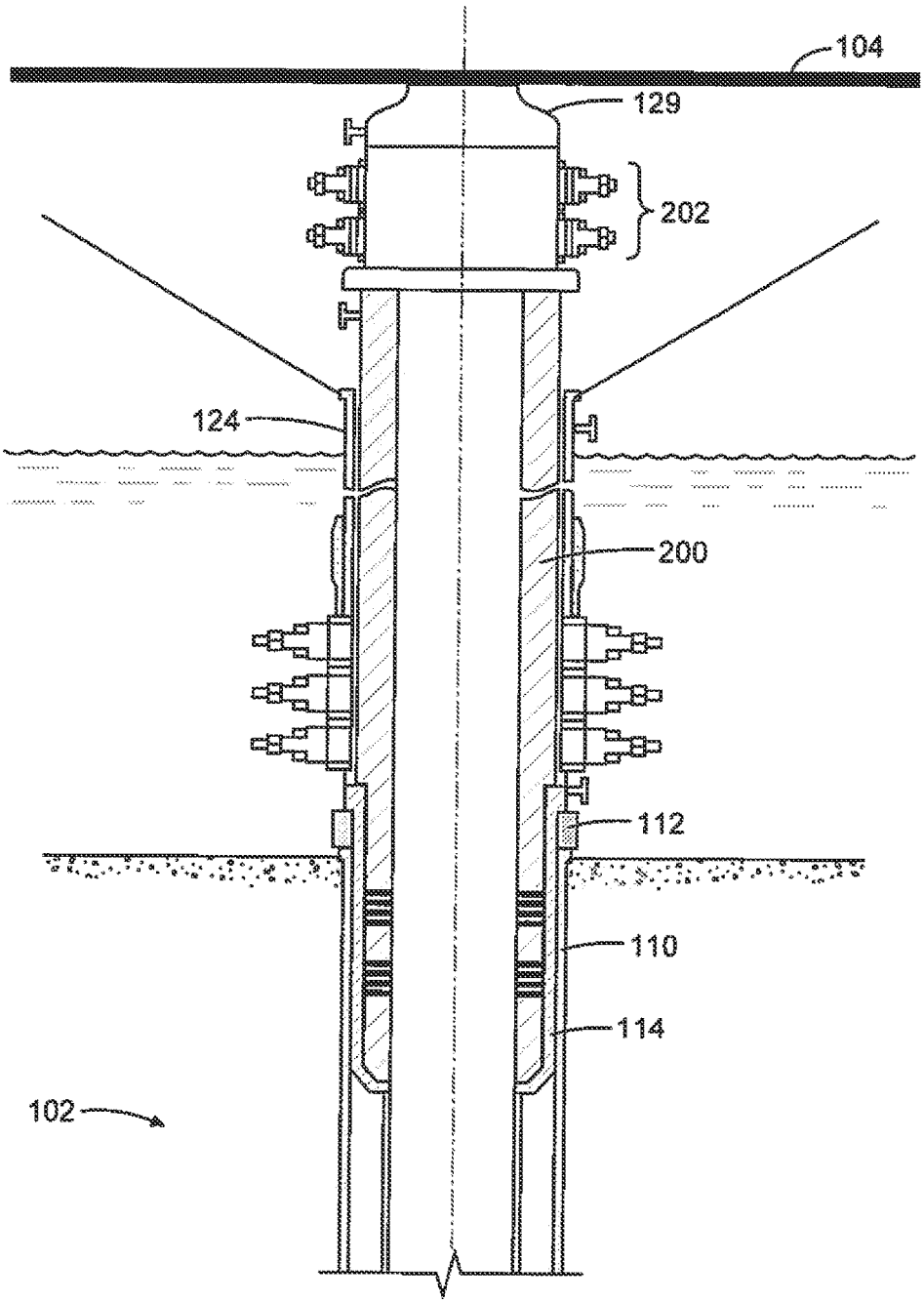
FIG. 2 illustrates a marine riser isolation system according to various embodiments.
Figure 3:
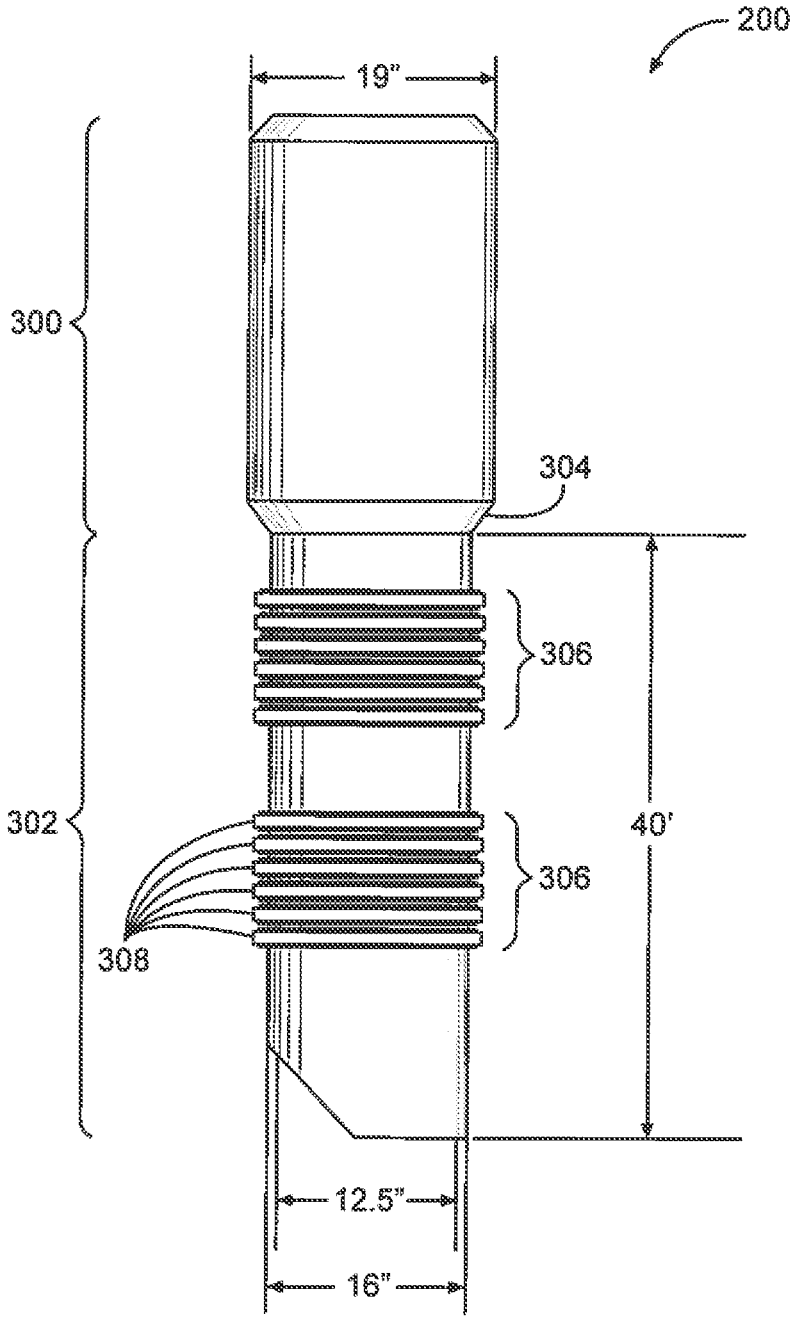
FIG. 3 depicts a marine riser isolation tool according to various embodiments.

FIG. 2 illustrates a riser isolation system following its installation between the rig floor and the well. As can be seen by comparison with FIG. 1, the upper part 128 of the marine riser 100 has been removed, and an RIT 200 has been installed inside the lower riser part 124 and inserted into the well 102. (The term "inside" in this context is not intended to mean that the RIT in its entirety is contained inside portions of the original riser. Rather, as is clear from FIG. 2, the upper and lower ends of the RIT may extend beyond the ends of the lower riser part.) The RIT 200 is connected to the rig floor 104 via an upper BOP 202 and the bell nipple 129. Referring to FIGS. 2 and 3, the RIT 200 may be formed by a tubular structure including two sections: a tool body 300 and, connected thereto at a lower end, a seal stinger 302. (The terms "lower" and "upper," as used herein, are generally to be understood with reference to the orientation of the RIT 200 or other part following proper installation. Thus, the lower end of the tool body is the end closer to the wellhead 112 once the RIT 200 is installed.)

The inner diameter of the tubular structure may be uniform across its entire length, and is sized to accommodate at least the drill string used to penetrate the reservoir, and optionally, larger-diameter drill strings that are used earlier or later in the drilling process. For example, in some embodiments, the ID of the RIT 200 is 12.5", which is sufficiently wide for using a 12¼" drill bit after installation of the RIT 200. As explained further below, such an RIT 200 would not be installed until after completion of the 13⅜" section 116 of the well casing. The OD of the RIT may differ between the tool body 300 and the seal stinger 302, the OD of the stinger 302 being smaller. For example, an RIT 200 used in conjunction with a common 21" OD×19¾" ID riser 100, 20" surface casing 110, and a receptacle 114 having a 16" ID may have a tool-body OD of 19" and a stinger OD of 16" (or slightly less), such that the stinger 302 fits tightly into the receptacle 114 while the tool body 300, with its outer rim 304 at the interface with the stinger 302, can rest on top of the receptacle 114. Thus, the structure of the RIT 200, as shown, may inherently provide a mechanical stop for the RIT 200 as it is landed in the receptacle 114. Of course, in other embodiments, the RIT 200 may have different dimensions, depending on the dimensions of the marine riser 100, receptacle 114, etc. Importantly, the largest OD of the RIT 200 is generally sufficiently smaller than the ID of the riser 100 to create a discernible annulus (e.g., having a thickness of at least ¼" or of at least ½") between the RIT 200 and the riser 100 to avoid mechanical binding (sticking) therebetween.

The seal stinger 302 is slidable inside the receptacle 114 (along its longitudinal axis), so that the RIT 200 can move vertically as the rig moves up or down. The length of the stinger 302 is generally chosen such that at least a portion of the stinger 302 remains inserted in the receptacle 114 throughout the full expected range of rig heave. For example, in some embodiments, the stinger 302 has a length between 20 feet and 60 feet, e.g., 40 feet, but the length may vary depending on the location of deployment. Assuming that the marine riser 100 is designed adequately to accommodate any rig heave, the stinger length may be chosen to reflect (e.g., be approximately equal to or exceed) the length of the upper portion of the marine riser 100.

To provide a fluid-tight seal between the exterior of the stinger 302 and the interior of the receptacle 114 as the stinger 302 moves up and down inside the receptacle 114, the seal stinger 302 may include one or more stacks 306 of sealing rings 308, as shown in FIG. 3. In some embodiments, two or more stacks 306 are used, and each stack 306 may include several (e.g., five, ten, or more) rings 308, e.g., placed at equal intervals. The rings 308 may (but need not) be seated in circumferential grooves to aid their retention. The rings 308 may be made of any of a number of elastomeric materials, including, e.g., nitrile, fluorocarbons, silicone, ethylene-propylene, polyurethane, natural rubbers, etc.

The RIT body 300 may be made of a high-strength, low-density material, such as, for instance, 2014 aluminum alloy or another suitable metal or metal alloy, or carbon fiber. (The stinger 302 may be made of the same material as the body 300, or of another material, e.g., steel.) The combination of a suitable material and greater wall thickness, compared with a common marine riser, can result in burst and collapse pressure ratings that by far exceed the ratings of the marine riser. For example, burst ratings in excess of 8,000 psi, 12,000 psi, or even 18,000 may be achievable. For comparison, a common L-80 grade steel marine riser has a burst rating of only slightly above 4,000 psi. Of course, these ratings are non-limiting examples. With different dimensions and materials of the RIT, even higher pressure ratings may be achieved. Conversely, in some environments, an RIT with pressure ratings below 8,000 psi may still be beneficial. The upper BOP 202 may be selected to have a similar pressure rating as the RIT with which it is employed (e.g., a rating that is no less than half of the rating of the RIT); for instance, with an RIT rated above 18,000 psi, an upper BOP rated for at least 15,000 psi may be suitable.

Figure 4:
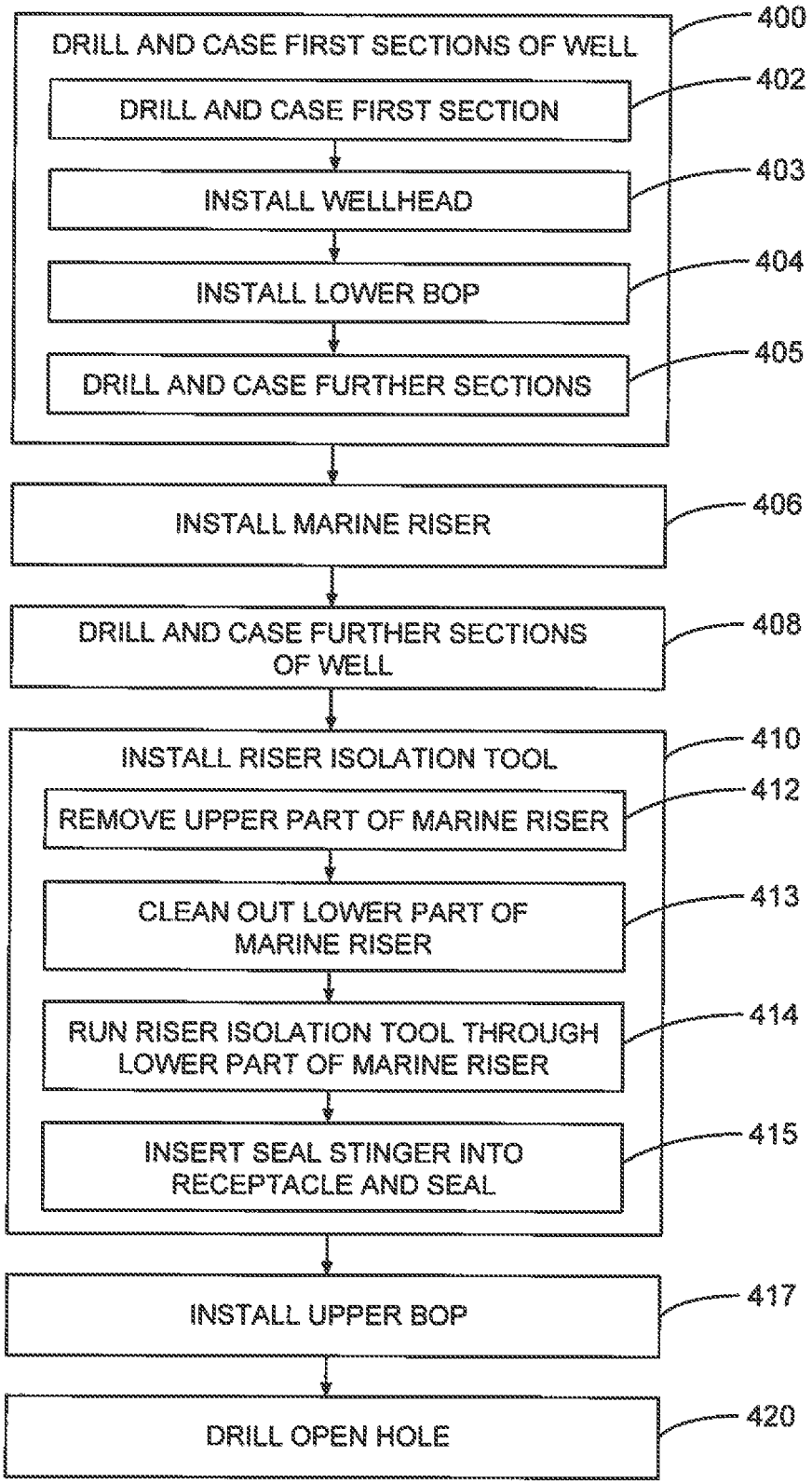
FIG. 4 is a flow diagram illustrating a method of installing a marine riser isolation tool in a marine riser according to various embodiments.

FIG. 4 illustrates an exemplary subsea drilling operation that involves use of a marine riser and, thereafter, installation of an RIT therein, in accordance with some embodiments. The operation may begin with the drilling and casing of the first one, two, or few sections of the borehole (without extending the borehole into the reservoir section at this stage) (400). To drill the hole, a drill string is lowered from the rig, generally under its own weight and suspended from a Felly or topdrive, through an opening in the rig floor (and, in some embodiments, through a rotary table mounted on the rig floor), using equipment and techniques well-known to those in the art of drilling. Once the drilling of a borehole section is completed, the drill string is pulled back up, and casing string is lowered in the same manner, inserted into the borehole, and cemented in place. Both the drill string and the casing string may include multiple sections, e.g., each 30 feet in length, which may be connected to each other with threaded joints. Drilling and casing may alternate, with decreasing diameters of the drill bit and casing string, until the desired number of borehole sections has been completed and cased. Following drilling and casing of the first section of the wellbore (402), a well-head may be installed (403) to hang subsequent casings therefrom. Further, a subsea BOP is mounted on the wellhead (404). Subsequent portions of the wellbore may then be drilled and cased (405). In some embodiments, an intermediate casing string (i.e., the second casing string) includes, as its uppermost joint, a polished-bore receptacle into which the RIT may later be inserted, as explained below.

Following drilling and casing of one more sections of the well, a marine riser may be installed (406) to provide an initial conduit between the subsea BOP and the rig. As described above with respect to FIGS. 1 and 2, the marine riser may have upper and lower parts slidably coupled to each other. Like the casing, either or both of the riser parts may include multiple sections of pipe connected via threaded joints.

Methods of riser installation are well-known to those of ordinary skill in the art. In general, installing the riser involves running the lower riser part through the rotary table and/or rig floor, securing it at the bottom to the wellhead and subsea BOP, attaching tensioner cables fastened to the rig floor to the top of the lower part, running the upper riser part through the rotary table and/or rig floor, inserting it into the lower part, securing it at the top to the rig floor (e.g., via a bell nipple extending from bottom of the floor), and adjusting the cable tension. During subsequent drilling operations (408), drill mud with cuttings or other fluids can rise from the wellbore through an annulus formed between the drill string and the marine riser to the surface facility.

Prior to drilling the open hole (420), the pressure tolerance of the conduit between the well and the surface facility may be increased via installation of an RIT (410). In preparation of RIT installation, the riser may be flushed clean of any debris (412), e.g., via tubing connected to its inlet(s) and outlet(s), and the upper part of the marine riser may thereafter be removed (413), e.g., by releasing the slip joint and pulling the upper riser part back through the opening in the rig floor. Then, the RIT is run through the rotary table and/or the opening in the rig floor, and through the lower part of the marine riser (414). (Running the RIT through the lower part of the marine riser is not intended to mean that the RIT in its entire has to enter (or even exit) the riser. Rather, an upper end of the RIT may, and generally does, extend above the upper end of the riser, as shown, e.g., in FIG. 2.) Like the riser, the RIT may include multiple sections of pipe that are sequentially run through the rotary table and/or floor opening and connected via threaded joints to for a continuous tubular structure. The seal stinger of the RIT is inserted into the receptacle and sealed against an interior wall of the receptacle (415). Finally, since the subsea BOP has been isolated from the wellbore by the RIT, an upper BOP is installed at the top of the RIT (417) (e.g., by bolting the upper BOP and RIT together), and the RIT is secured, via the upper BOP to the surface facility. For example, the upper BOP may be bolted or otherwise attached to a bell nipple extending downward from the floor.

As will be readily appreciated by those of ordinary skill in the art, not all of the above-described acts need to be executed, or executed in the exact order disclosed, in every embodiment. Furthermore, additional actions may be involved in drilling operations in accordance herewith, particularly, in the installation, use, and partial de-installation of the riser and the installation and use of the RIT. It will also be readily understood by those of ordinary skill in the art that the marine riser, RIT, wellbore, and other system components discussed herein are depicted in simplified schematic form, and may include additional or different components, differ in their dimensions, operate in a different manner, etc. while stilling falling within the scope of the present disclosure. In general, the various embodiments described herein are intended to be illustrative and not limiting, and it is understood that various modifications incorporating the concepts disclosed herein exist.

What is claimed is:

1. A method, comprising:

installing a marine riser to provide an initial conduit between a subsea blowout preventer mounted above a subsea wellhead and a surface drilling facility, the marine riser comprising an upper part and a lower part slidably coupled therewith;

removing the upper part of the marine riser;

after removal of the upper part of the marine riser, running a riser isolation tool through the lower part of the marine riser, the riser isolation tool comprising a body section having burst and collapse pressure ratings exceeding burst and collapse pressure ratings of the marine riser and, connected to the body section at a lower end thereof, a seal stinger;

inserting the seal stinger into a receptacle seated in the wellhead to mount the seal stinger slidably in the receptacle, and sealing the seal stinger against an interior wall of the receptacle; and installing an upper blowout preventer between an upper end of the riser isolation tool and the surface drilling facility.

2. The method of claim 1, wherein installing the upper blowout preventer comprises securing the upper blowout preventer to the surface drilling facility via a bell nipple.

3. The method of claim 1, wherein the upper part of the marine riser is removed, the riser isolation tool is run through the lower part of the marine riser, the seal stinger is inserted into the receptacle, and the upper blowout preventer is installed prior to penetrating a reservoir during drilling.

4. A system comprising:

a lower marine riser part extending upward from a subsea blowout preventer mounted on a wellhead;

a receptacle hung from the wellhead; and a riser isolation tool installed inside the lower marine riser part and having a maximum outer diameter smaller than an inner diameter of the lower marine riser part with an upper end of the riser isolation tool extending upward from an upper end of the lower marine riser part, the riser isolation tool comprising:

a tubular tool body having burst and collapse pressure ratings exceeding the burst and collapse pressure ratings of the lower marine riser part; and a seal stinger comprising (i) a tubular component connected to a lower end of the tool body and sized to fit inside the receptacle, and (ii) disposed at multiple locations along a length of the tubular component, seal stacks circumferentially surrounding the tubular component.

5. The riser isolation tool of claim 4, wherein the tool body comprises 2014 aluminum alloy.

6. The riser isolation tool of claim 4, wherein the tool body has a burst rating exceeding the burst rating of an L-80 grade steel marine riser by a factor of at least two.

7. The riser isolation tool of claim 4, wherein the tool body and the tubular component of the seal stinger form a continuous tubular structure of uniform inner diameter.

8. The riser isolation tool of claim 4, wherein the tool body has an outer diameter of about 19 inches and an inner diameter of about 12.5 inches.

9. The riser isolation tool of claim 4, wherein an outer diameter of the tubular component of the seal stinger is smaller than an outer diameter of the tool body.

10. The riser isolation tool of claim 4, wherein the seal stacks comprise sealing rings seated in circumferential grooves of the tubular component of the seal stinger.

11. The riser isolation tool of claim 4, wherein the seal stinger has a length of between about twenty feet and about sixty feet.

12. A riser isolation system comprising:

a riser isolation tool for installation at least partially inside a marine riser between a wellhead and a surface drilling facility, the riser isolation tool comprising a body section having burst and collapse pressure ratings exceeding burst and collapse pressure ratings of the marine riser and, connected to the body section at a lower end thereof, a seal stinger having a smaller outer diameter than the body section and being configured to be slidably received in and sealed against a receptacle seated in the wellhead; and an upper blowout preventer for insertion between an upper end of the body section and the surface drilling facility, wherein installation of the upper blowout preventer secures the body section to the surface facility.

13. The system of claim 12, wherein the upper blowout preventer is rated for at least 15,000 psi.

14. The system of claim 12, wherein the receptacle comprises a polished bore receptacle.

15. The system of claim 12, wherein the riser isolation tool comprises 2014 aluminum alloy.

16. The system of claim 12, wherein the riser isolation tool has a burst rating exceeding the burst rating of an L-80 marine riser by a factor of at least two.

17. The system of claim 12, wherein the riser isolation tool has an outer diameter smaller than an inner diameter of the marine riser.

18. The system of claim 12, wherein the seal stinger comprises a tubular component connected to the lower end of the body section and, disposed at multiple locations along a length of the tubular component, seal stacks circumferentially surrounding the tubular component.

19. The system of claim 18, wherein the seal stacks comprise sealing rings seated in circumferential grooves of the tubular component of the seal stinger.

20. The system of claim 12, wherein the seal stinger has a length of between about twenty feet and about sixty feet.

* * * * *